US005526907A

United States Patent [19]

Trawick et al.

[11] Patent Number: 5,526,907

[45] Date of Patent: Jun. 18, 1996

[54] BEACH CARRY BAG

[76] Inventors: Jason Trawick; William Trawick, both of 26 Maria Ct., Holbrook, N.Y. 11741

[21] Appl. No.: 410,137

[22] Filed: Mar. 23, 1995

[51] Int. Cl.[6] ..... B65D 30/20; B65D 30/22; B65D 33/06

[52] U.S. Cl. ..... 190/111; 383/15; 383/110

[58] Field of Search ..... 190/109, 110, 190/111; 383/15, 110, 38

[56] References Cited

U.S. PATENT DOCUMENTS

| | | | |
|---|---|---|---|
| 2,540,165 | 2/1951 | Fiel | 190/111 |
| 4,082,208 | 4/1978 | Lane | 224/8 R |
| 4,140,164 | 2/1979 | Staup | 383/15 |
| 4,273,221 | 6/1981 | Poag | 190/8 |
| 4,298,103 | 11/1981 | De Fries | 190/42 |
| 4,334,601 | 6/1982 | Davis | 190/111 |
| 4,546,507 | 10/1985 | Weinstein | 5/419 |
| 4,592,091 | 5/1986 | Italici | 383/15 |
| 4,648,512 | 3/1987 | Tarozzi | 206/542 |
| 4,667,484 | 5/1987 | Tarozzi | 62/371 |
| 4,679,407 | 7/1987 | Kim | 62/294 |
| 4,773,515 | 9/1988 | Kotkins | 190/103 |
| 4,825,892 | 5/1989 | Norman | 135/104 |
| 4,826,060 | 5/1989 | Hollingsworth | 224/205 |
| 4,856,912 | 8/1989 | Damus | 383/4 |
| 4,863,075 | 9/1989 | Romer | 222/610 |
| 4,873,841 | 10/1989 | Bradshaw | 62/239 |
| 4,967,986 | 11/1990 | Schildkraut | 224/250 |
| 5,005,679 | 4/1991 | Hjelle | 190/111 |
| 5,030,013 | 7/1991 | Kramer | 383/61 |
| 5,031,807 | 7/1991 | Tiffany | 224/35 |
| 5,054,507 | 10/1991 | Sparks | 135/97 |
| 5,067,405 | 12/1991 | Modica | 190/1.0 |
| 5,140,833 | 8/1992 | Whalen | 62/457.7 |
| 5,234,143 | 8/1993 | Mahvi | 224/31 |
| 5,275,018 | 1/1994 | Lin | 62/457 |
| 5,318,312 | 6/1994 | Montemayor | 280/30 |
| 5,346,308 | 9/1994 | Buhot | 383/4 |
| 5,350,081 | 9/1994 | Graham | 220/737 |

OTHER PUBLICATIONS

*Lillian Vernon Catalog*, Virginia Beach, VA, 23479-0002 "Sports Bag Holds Gear with Room to Spare", vol. 501, p. 47, 1995.

*Primary Examiner*—Stephen P. Garbe
*Attorney, Agent, or Firm*—Alfred M. Walker

[57] ABSTRACT

A beach accessory carry bag which is particularly suited for beach use. The beach carry bag includes a compact, light-weight carry case which can be carried long distances from a motor vehicle in a beach parking lot to a remote beach location. The beach carry bag also generally includes a thermally insulated storage compartment for storage of refrigerated, cooled beverages and perishable foods therein. Within the beach carry bag there is also provided a plurality of small non-insulated compartments for carrying beach accessories, such as sun tan lotion, insect repellent, car keys and sunglasses, and one or more larger compartments for storage of street clothes therein. Expandable, collapsible end compartments may be provided for storage of footwear, such as sneakers or shoes, therein. A lower slot pocket storage compartment is provided for insertion of a flat fabric beach towel or mat therein, wherein the beach towel or mat has an inflatable rest portion which can be deflated for storage after use.

3 Claims, 14 Drawing Sheets

BEACH CARRY BAG

FIELD OF THE INVENTION

The present invention relates to portable multi-compartment beach carry bags.

BACKGROUND OF THE INVENTION

Various attempts have been made to provide multi-compartment carry bags.

Among these beach accessory bags include U.S. Pat. No. 4,082,205, which describes a back pack with an ice chest built therein. U.S. Pat. No. 4,273,221 describes a combination valise which converts into a back rest to sit against on a beach. U.S. Pat. No. 4,298,103 describes combination carrying bag with multi-compartments with a refrigeration compartments, wherein the bag converts to a head rest.

U.S. Pat. No. 4,546,507 describes a beach kit which converts to a pillow cover. U.S. Pat. No. 4,648,512 describes a portable insulated beverage cooler with auxiliary pockets. U.S. Pat. No. 4,667,484 describes a beverage cooler with a lid, which cooler further contains a small carrying compartment in the lid. U.S. Pat. No. 4,679,407 describes a portable beverage cooler.

U.S. Pat. No. 4,773,515 describes a multi-compartment expandable luggage bag with expandable end compartments with flexible membrane walls to expand the size of the compartments. U.S. Pat. No. 4,825,842 describes a portable beach cabana structure. U.S. Pat. No. 4,826,060 describes a cooler bag and U.S. Pat. No. 4,856,912 describes a combination beach towel and tote bag which includes a circular pouch portion built into the center of the towel.

U.S. Pat. No. 4,863,075 describes a beach caddy vehicle with wheels. U.S. Pat. No. 4,873,841 describes a portable cooler. U.S. Pat. No. 4,967,986 describes a beach carry bag which converts to a cylindrical form to carry a beach towel therein. U.S. Pat. No. 5,030,013 describes a waterproof bag and U.S. Pat. No. 5,031,807 describes a bicycle case which has multi-compartments for sports and beach use.

U.S. Pat. No. 5,054,507 describes a portable beach cache carrier which opens to shelter the user. U.S. Pat. No. 5,076,405 describes a combination beach carry bag which is also in the form of a chair seat. U.S. Pat. No. 5,140,833 describes a locking cover to enclose a portable cooler therein.

U.S. Pat. No. 5,234,143 describes an infant carrying seat for bicycles wherein the seat functions as a travel bag. U.S. Pat. No. 5,318,312 describes a portable folding utility carrier with wheels to transport the carrier. U.S. Pat. No. 5,275,018 describes a beach accessory which converts to arm rests. U.S. Pat. No. 5,346,308 describes a beach bag which converts into a beach towel and U.S. Pat. No. 5,350,081 describes a portable beverage cooler.

Moreover, a portable multi-compartment bag is described in an advertisement of Lillian Vernon publications entitled "Sports Bag Holds Gear With Room to Spare".

While many of the features which are desirable in a beach accessory carry bag are individually found singularly in the prior art, none of the prior art carry bags are particularly suited for beach use, in that they do not include a carry case which is compact and lightweight for carrying long distances from a motor vehicle to a beach location, wherein a thermally insulated storage compartment is provided, together with a plurality of compartments for carrying beach accessories and street clothes therein, wherein further a lower slot pocket storage compartment is provided for insertion of a flat fabric beach towel or mat therein, wherein the beach towel or mat has an inflatable rest portion which can be deflated for storage after use.

OBJECTS OF THE INVENTION

It is therefore an object of the present invention to provide a beach accessory carry bag which is particularly suited for beach use.

It is also an object of the present invention to provide a compact, lightweight beach carry case which can be carried long distances from a motor vehicle in a beach parking lot to a remote beach location.

It is yet an object of the present invention to provide a versatile beach carry bag with a thermally insulated storage compartment for storage of refrigerated, cooled beverages and perishable foods therein.

It is an object of the present invention to provide a beach carry bag with a plurality of small non-insulated compartments for carrying beach accessories, such as sun tan lotion, insect repellent, car keys and sunglasses.

It is an object of the present invention to provide a beach carry bag with one or more larger compartments for storage of street clothes therein.

It is a further object of the present invention to provide a beach carry bag with expandable, collapsible end compartments which may be provided for the storage therein of footwear, such as sneakers or shoes.

It is an object of the present invention to provide a beach carry bag with a thin storage compartment for insertion of a flat fabric beach towel or mat therein, wherein the beach towel or mat has an inflatable rest portion which can be deflated for storage after use.

It is yet a further object of the present invention to improve over the disadvantages of the prior art.

SUMMARY OF THE INVENTION

In keeping with these objects and others which may become apparent, the present invention includes a beach accessory carry bag which is particularly suited for beach use.

The beach carry bag includes a compact, lightweight carry case which can be carried long distances from a motor vehicle in a beach parking lot toga remote beach location. The beach carry bag also generally includes a thermally insulated storage compartment for storage of refrigerated, cooled beverages and perishable foods therein.

Within the beach carry bag there is also provided a plurality of small non-insulated compartments for carrying beach accessories, such as sun tan lotion, insect repellent, car keys and sunglasses, and one or more larger compartments for storage of street clothes therein. Expandable, collapsible end compartments may be provided for storage of footwear, such as sneakers or shoes, therein.

A lower slot pocket storage compartment is provided for insertion of a flat fabric beach towel or mat therein, wherein the beach towel or mat has an inflatable rest portion which can be deflated for storage after use.

Preferably, the beach carry bag of the present invention includes a generally rectangular top bisected into two compartments of substantially equal size. One compartment includes a rigid, thermally insulated beverage cooler with a thermally insulated lid. The other compartment includes a storage area for objects, such as clothing or reading material. The second compartment closes with a closure means, such as a zipper.

On each end of the beach carry bag there is provided an expandable pocket with flexible walls which expand to auxiliary compartments for objects such as footwear. When in a closed position, the pocket is held in place by a closure means such as a zipper.

A rectangular thin bottom pocket opens to hold a folded beach towel. The bottom pocket is also closed with a closure means such as a zipper or an elastic fastener strip. The beach towel may have an inflatable pillow portion, preferably at one end of the beach towel.

To hold the small items, such as suntan lotion containers, beverage cartons, etc., one side of the beach carry bag includes a plurality of generally rigid pockets, such as four pockets with operable lids held closed by hook and loop Velcro® type fasteners, or other types of closable flaps.

On an opposite side, a slotted thin pocket is provided for thin items, such as maps or magazines.

The beach carry bag is carried by a flexible handle, preferably including a pair of flexible strips attached to the top of the beach carry bag at corners thereof, wherein a closure means is provided to unite the two strips into a singular handle.

DESCRIPTION OF THE DRAWINGS

The present invention can best be described in conjunction with the accompanying drawings in which.

DETAILED DESCRIPTION OF THE DRAWINGS

Figure 1:
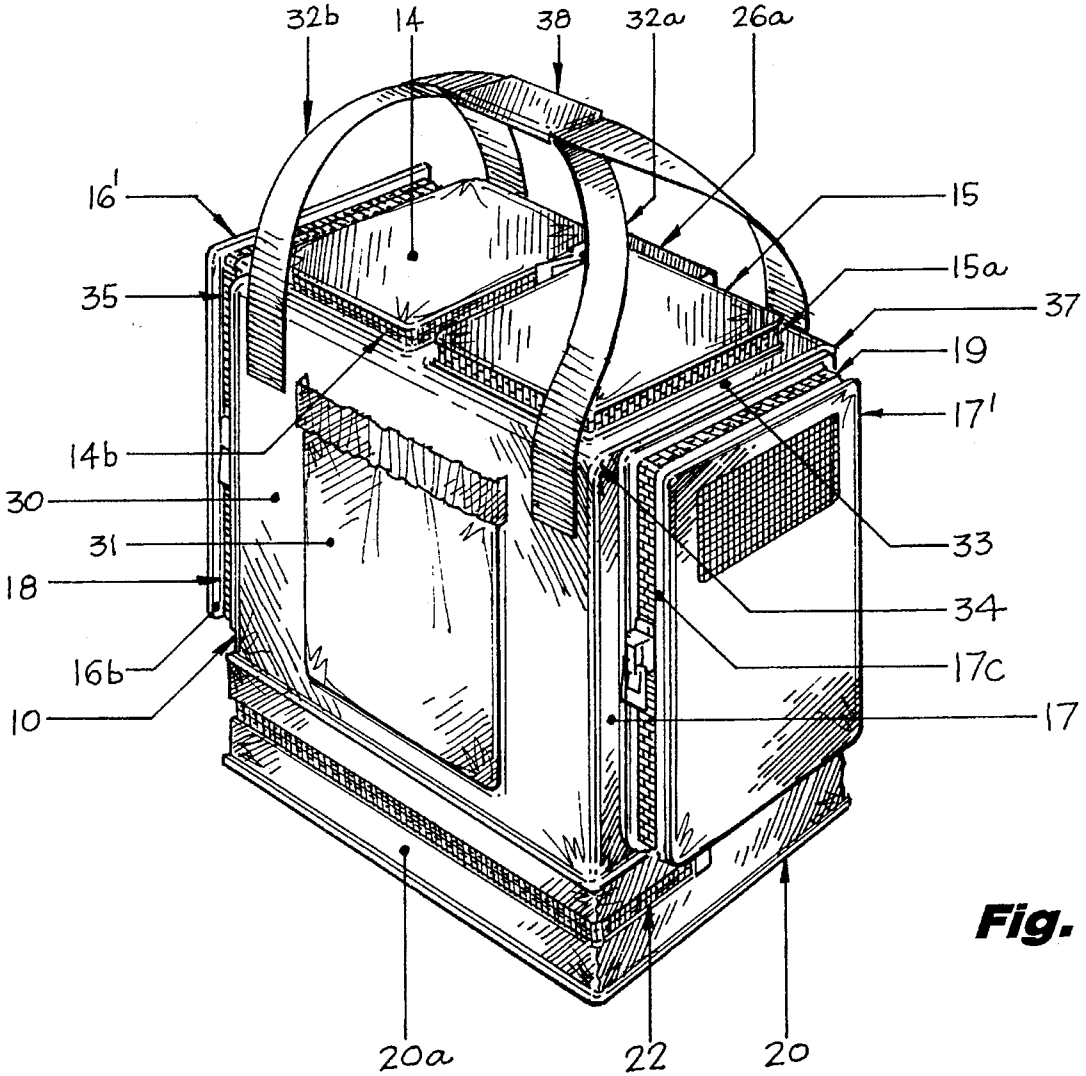
FIG. 1 is a perspective view of a beach bag of the present invention.
Figure 2:
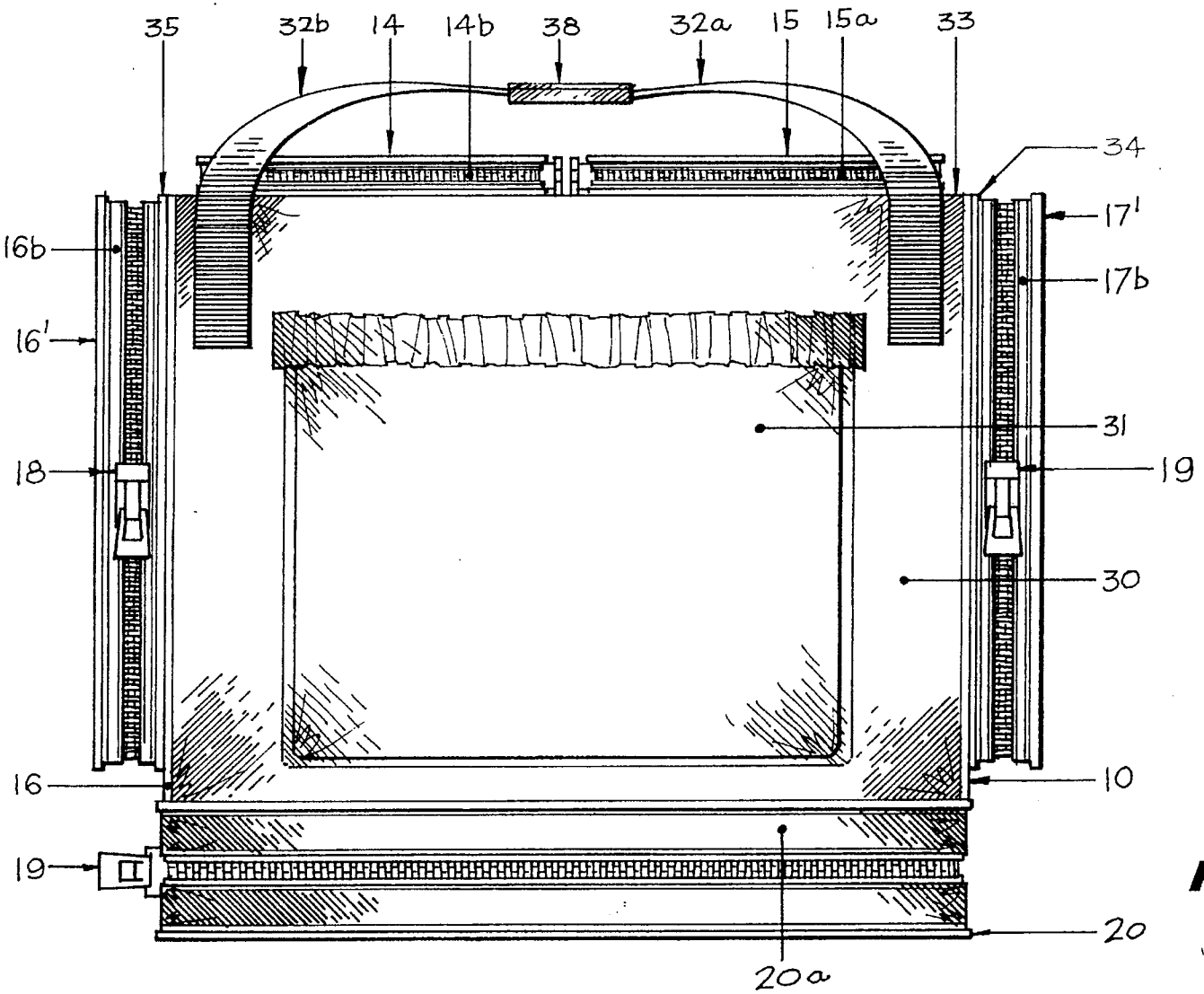
FIG. 2 is a front elevational view thereof.
Figure 3:
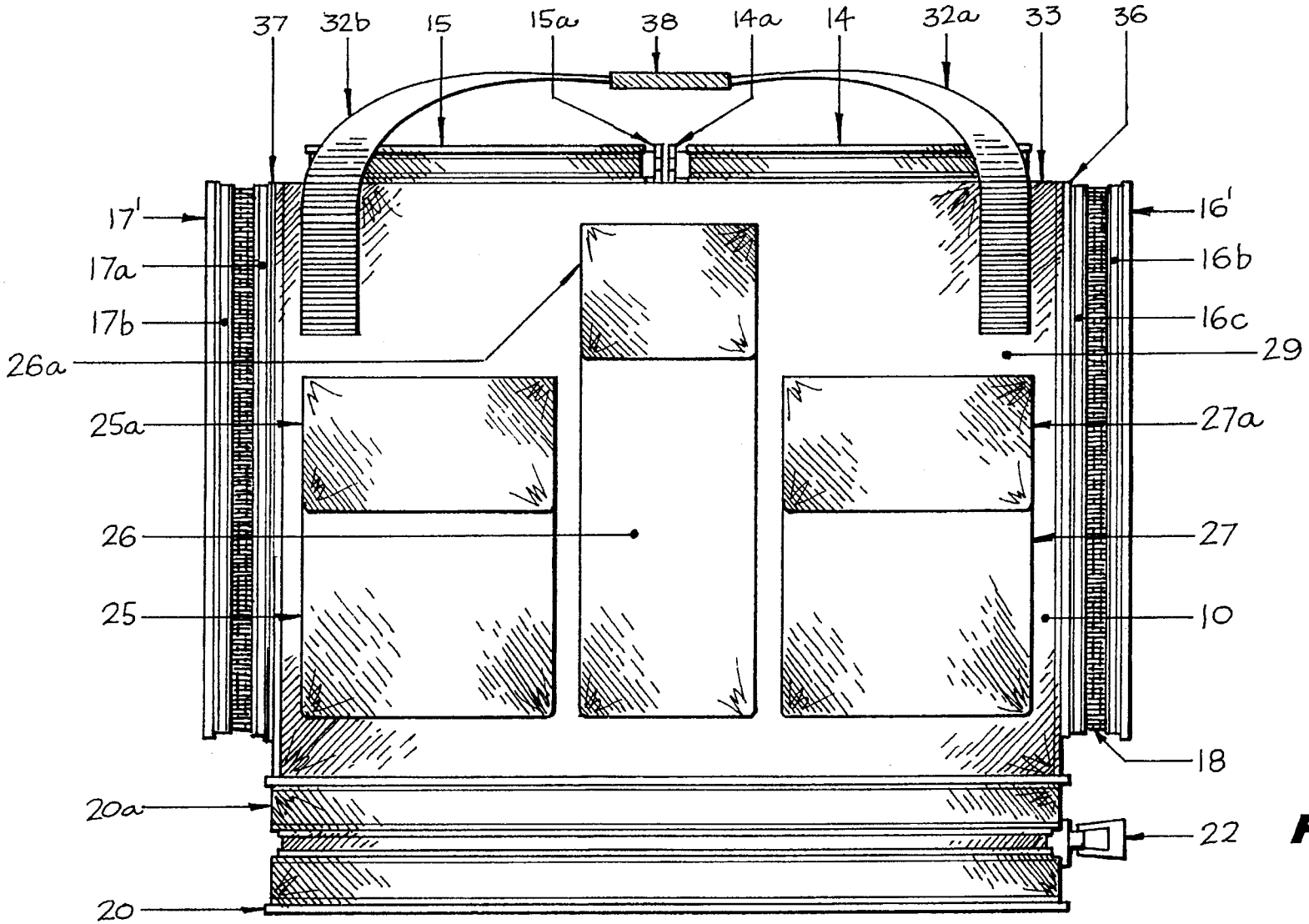
FIG. 3 is a rear elevational view thereof.
Figure 4:
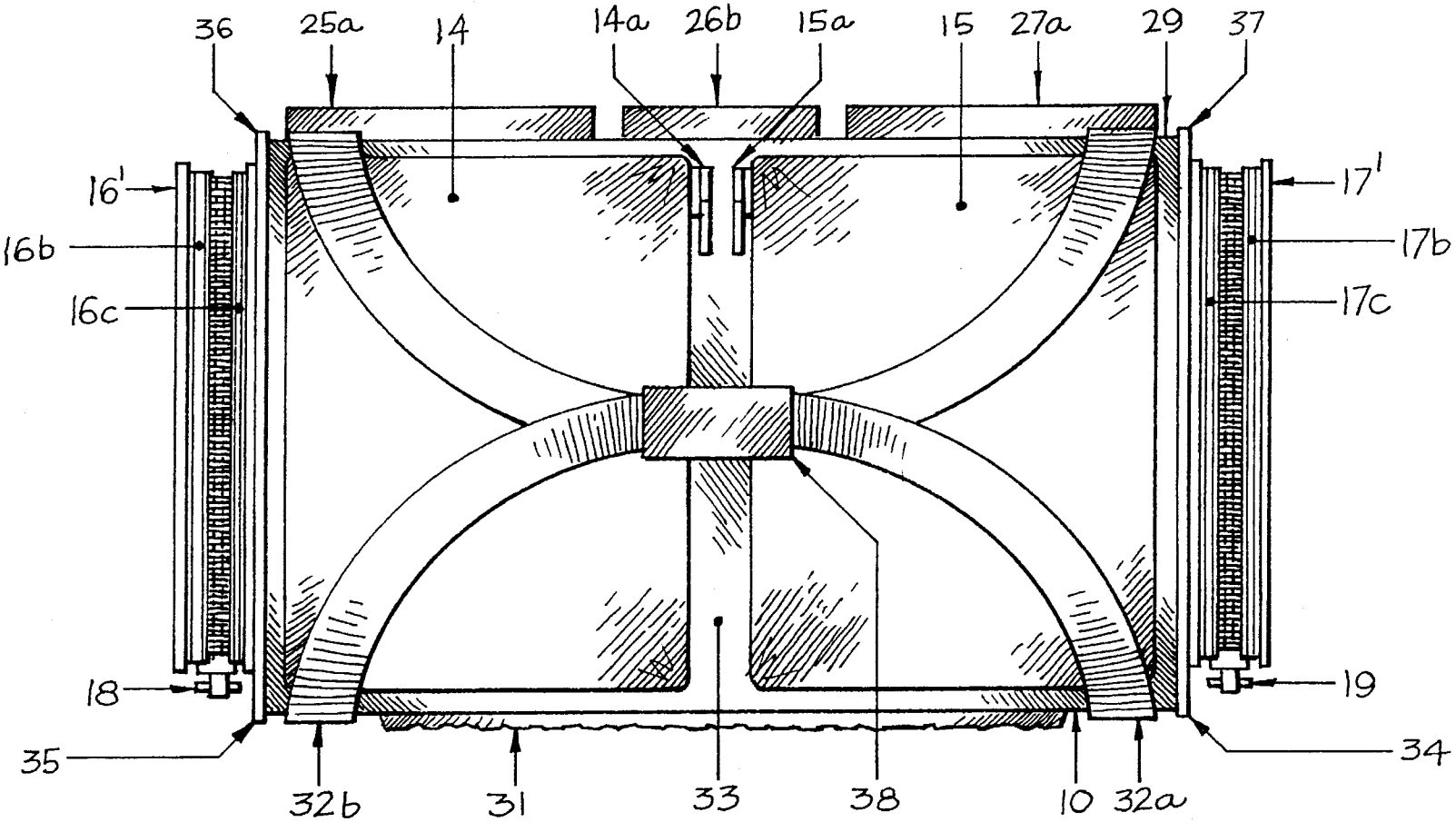
FIG. 4 is a top plan view thereof.
Figure 5:
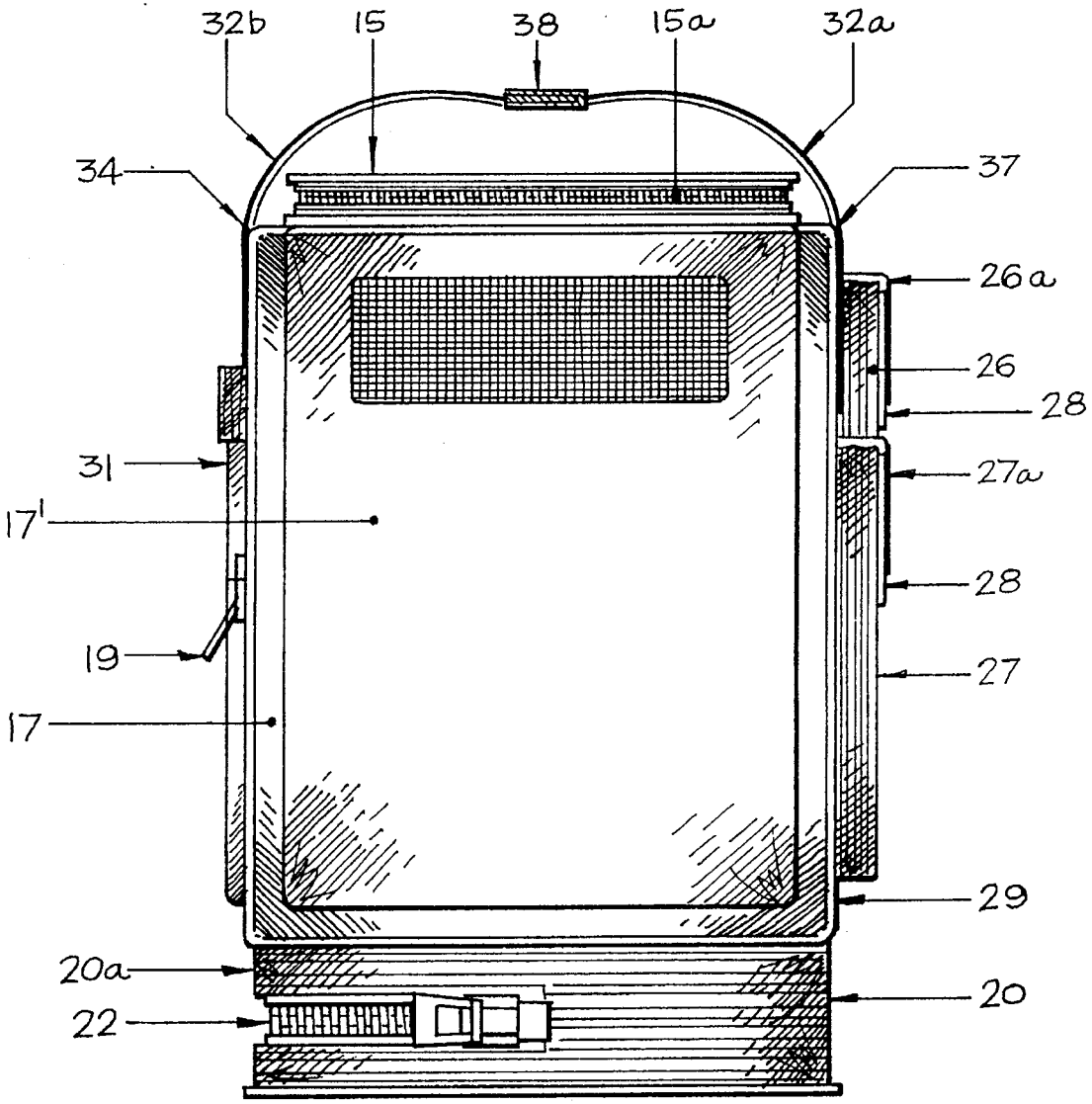
FIG. 5 is a right side elevational view thereof.
Figure 6:
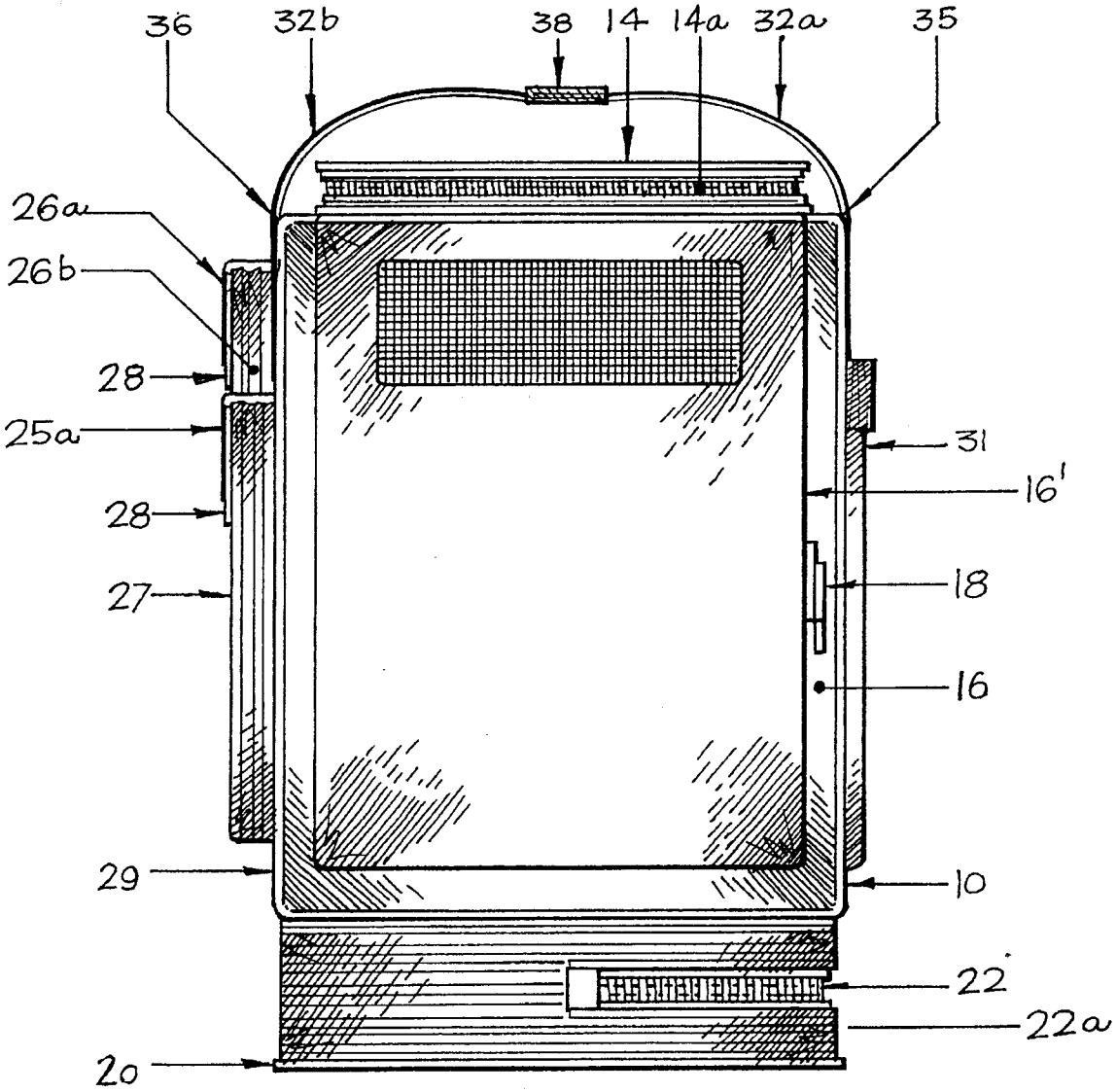
FIG. 6 is a left side elevational view thereof.
Figure 7:
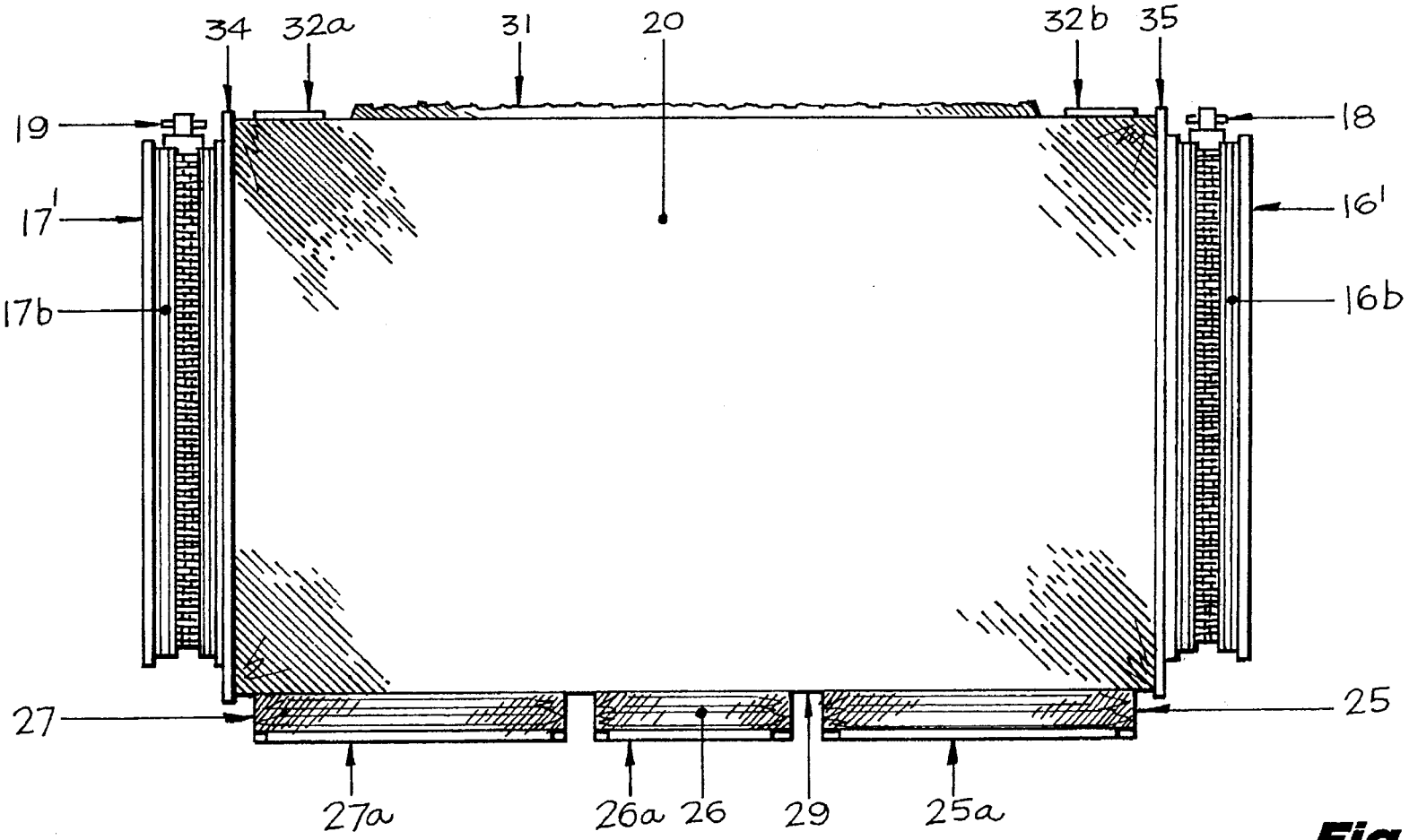
FIG. 7 is a bottom view thereof.

As shown in FIGS. 1–4, beach accessory carry 1 includes a compact, lightweight carry case 10 including thermally insulated storage compartment 12 for storage of refrigerated, cooled beverages and perishable foods therein.

In the preferred embodiment, within beach carry bag 10 there is also provided a lower slot pocket storage compartment is provided for insertion of a flat fabric beach towel or mat therein, wherein the beach towel or mat has an inflatable rest portion which can be deflated for storage after use.

Upon bottom 20 there is provided rectangular thin bottom pocket 20*a* with slot 20*b* which opens to hold a flat fabric material sheet 21, such as folded beach towel 21 therein. Bottom storage pocket 20 is also closed with a closure means 22 such as a zipper or an elastic fastener strip. Beach towel 21 may have one or more inflatable pillow portions 23, 24 at one end of beach towel 21, or beach towel itself may be fully inflatable to form an inflatable mattress.

Preferably, beach carry bag 10 of the present invention includes a generally rectangular top 11 bisected into two storage compartments 12, 13 of substantially equal size. One first storage compartment 12 includes a rigid, thermally insulated beverage cooler with a thermally insulated lid 12*a*. Further storage compartment 13 includes a storage area for objects, such as clothing. First thermally insulated storage compartment 12 and further storage compartment 13 are closed with covers 14, 15 closure means 14*a*, 15*a* respectively, such as a zipper.

On each side 16, 17 of beach carry bag 10 there is provided expandable storage pockets 16*a*, 17*a* with respective flexible walls 16*b*, 16*c*, 17*b*, 17*c* which expand out rigid walls 16' 17" to form auxiliary compartments for insertion of objects such as footwear therein. When in a closed position, storage pockets 16*a*, 17*a* are closed by closure means 18, 19, such as zippers.

To hold the small items, such as suntan lotion containers, beverage cartons, etc., one side 29 of beach carry bag 10 includes a plurality of generally rigid pockets, such as pockets 25, 26, 27 with operable lids 25*a*, 26*a*, 27*a* held closed by closure means, such as hook and loop Velcro® type fasteners 28, or other types of closable flaps.

On an opposite side 30, thin storage pocket 31 is provided for thin items, such as maps or magazines, wherein closure means 31*a*, such as an elastic strip 1 closes strap pocket 31.

Beach carry bag 10 is carried by a flexible handle 32, extending from corners 34, 35, 36, 37 of top 11, wherein handle 32 preferably includes a pair of flexible strips 32*a*, 32*b* attached to top 11 of beach carry bag 10 at corners 34, 35, 36, 37 thereof, wherein a closure means 38 is provided to unite strips 32*a*, 32*b* into a singular handle 32.

Moreover, thermally insulated storage compartment 12 is separated from non-insulated storage compartment 13 by thermally insulated panel 33 extending from top 11 to bottom 20 of beach carry case 10.

Figure 8:
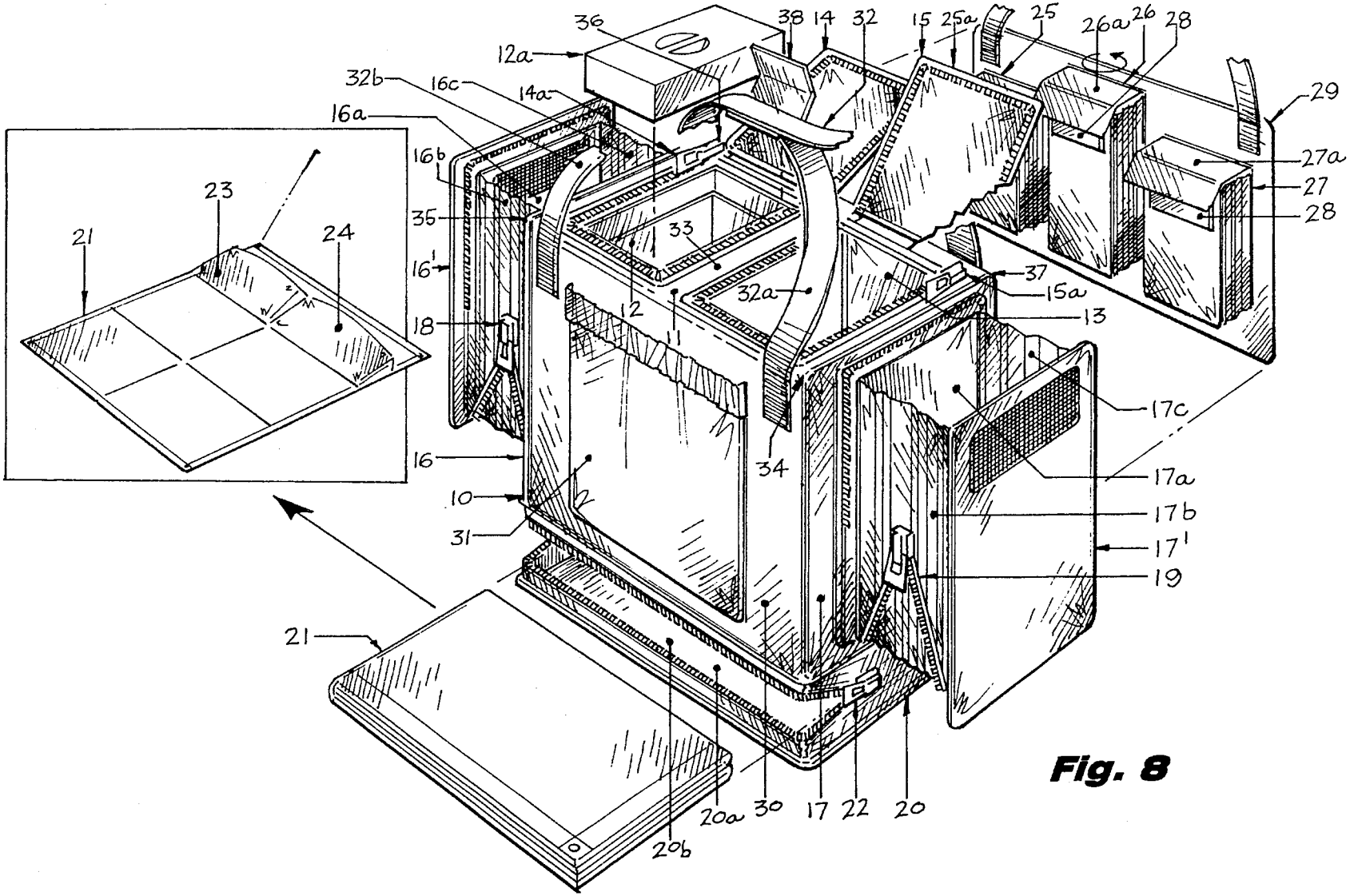
FIG. 8 is an exploded perspective view of the beach carrying bag of the present invention.
Figure 9:
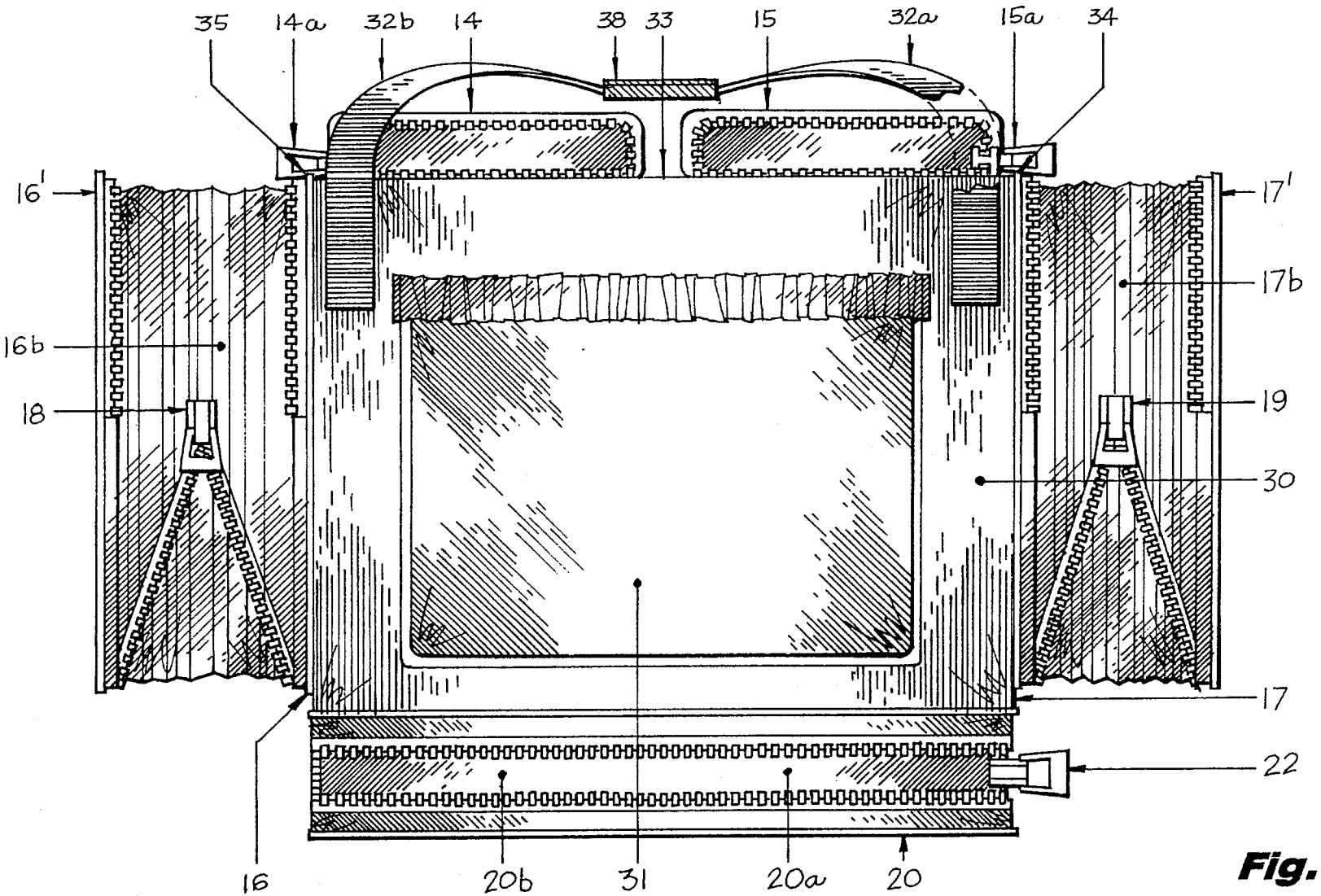
FIG. 9 is a front elevational view of the beach carrying bag as in FIG. 8, shown in a partially open position.
Figure 10:
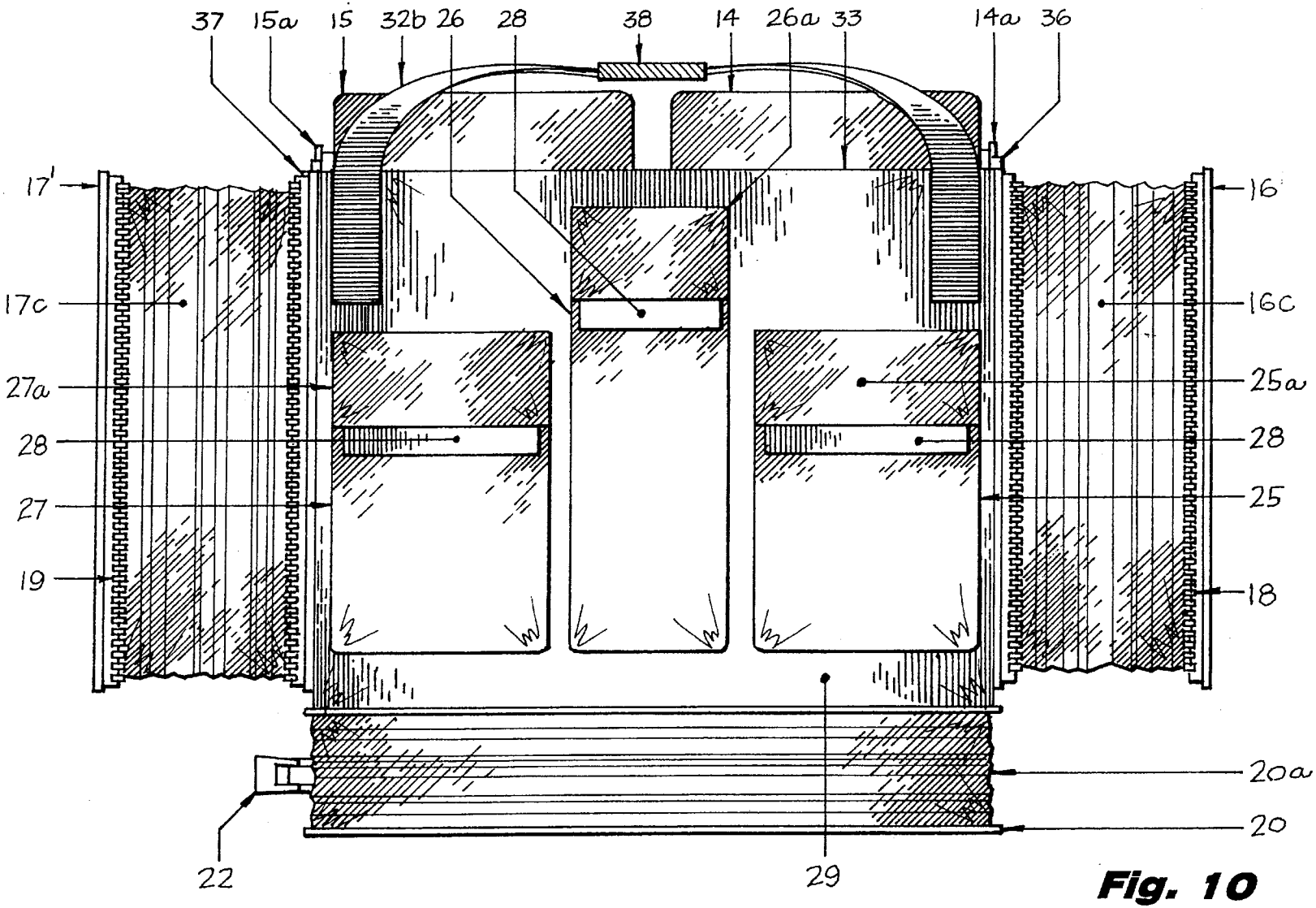
FIG. 10 is a rear elevational view of the beach carrying bag as in FIG. 8, shown in a partially open position.
Figure 11:
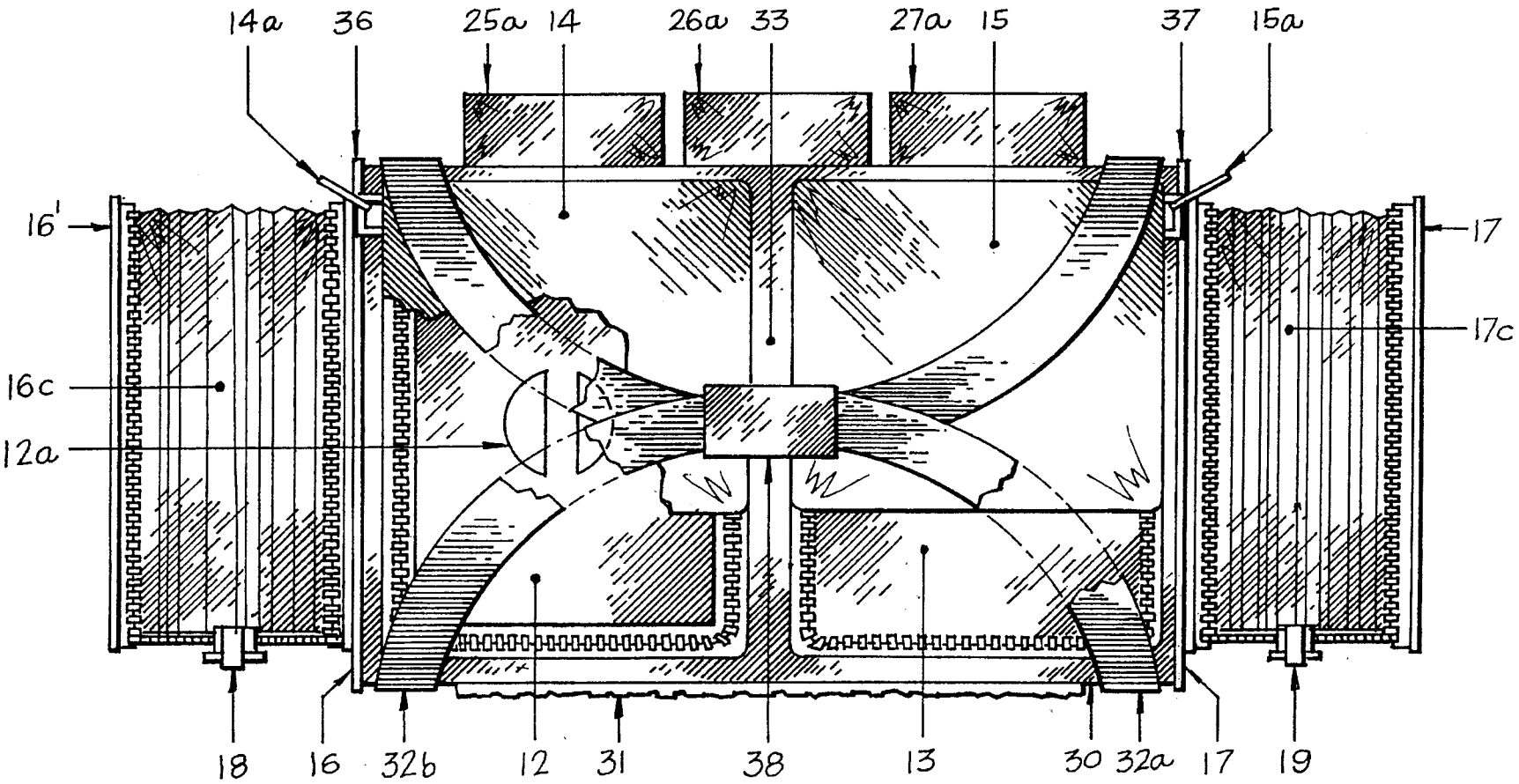
FIG. 11 is a top plan view of the beach carrying bag as in FIG. 8, shown in a partially open position.
Figure 12:
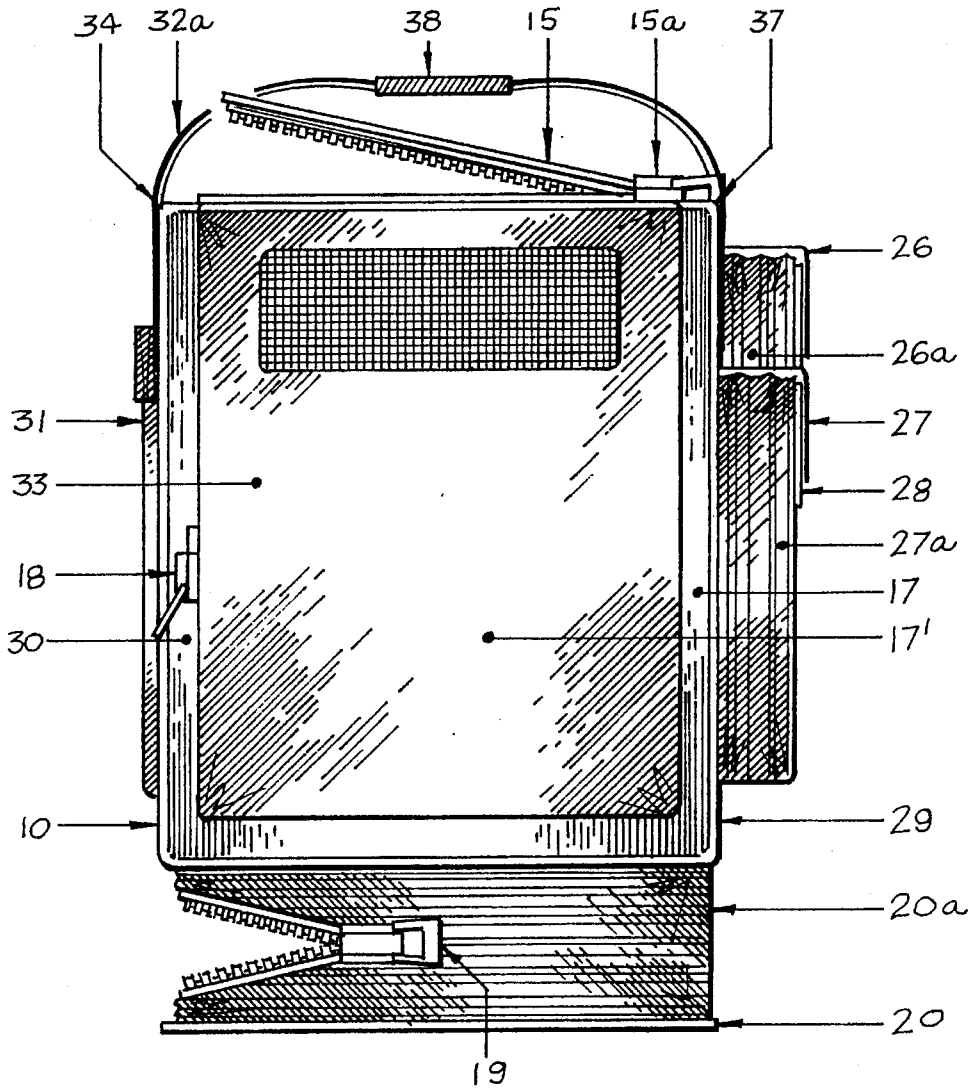
FIG. 12 is a right side elevational view of the beach carrying bag as in FIG. 8, shown in a partially open position.
Figure 13:
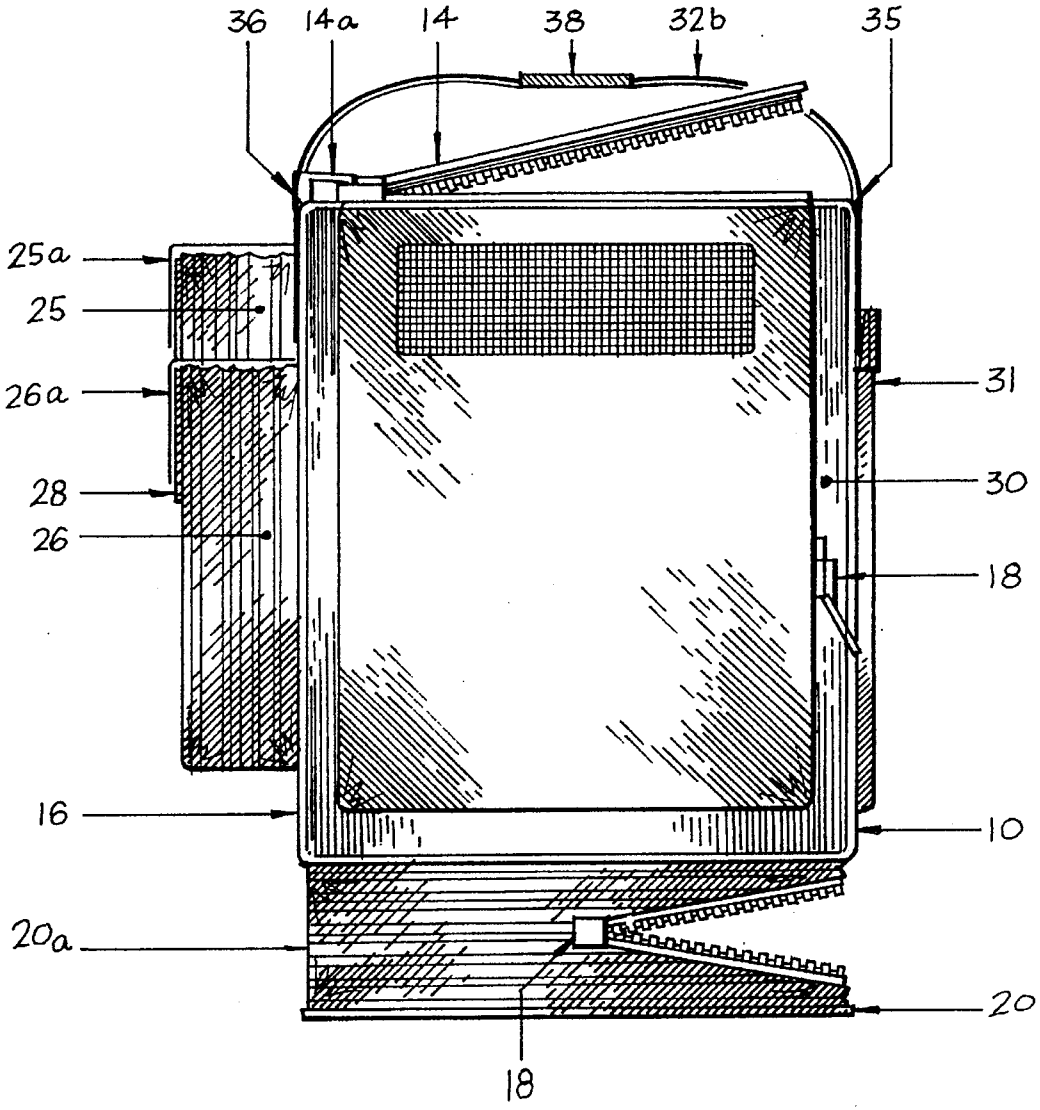
FIG. 13 is a left side elevational view of the beach carrying bag as in FIG. 8, shown in a partially open position.
Figure 14:
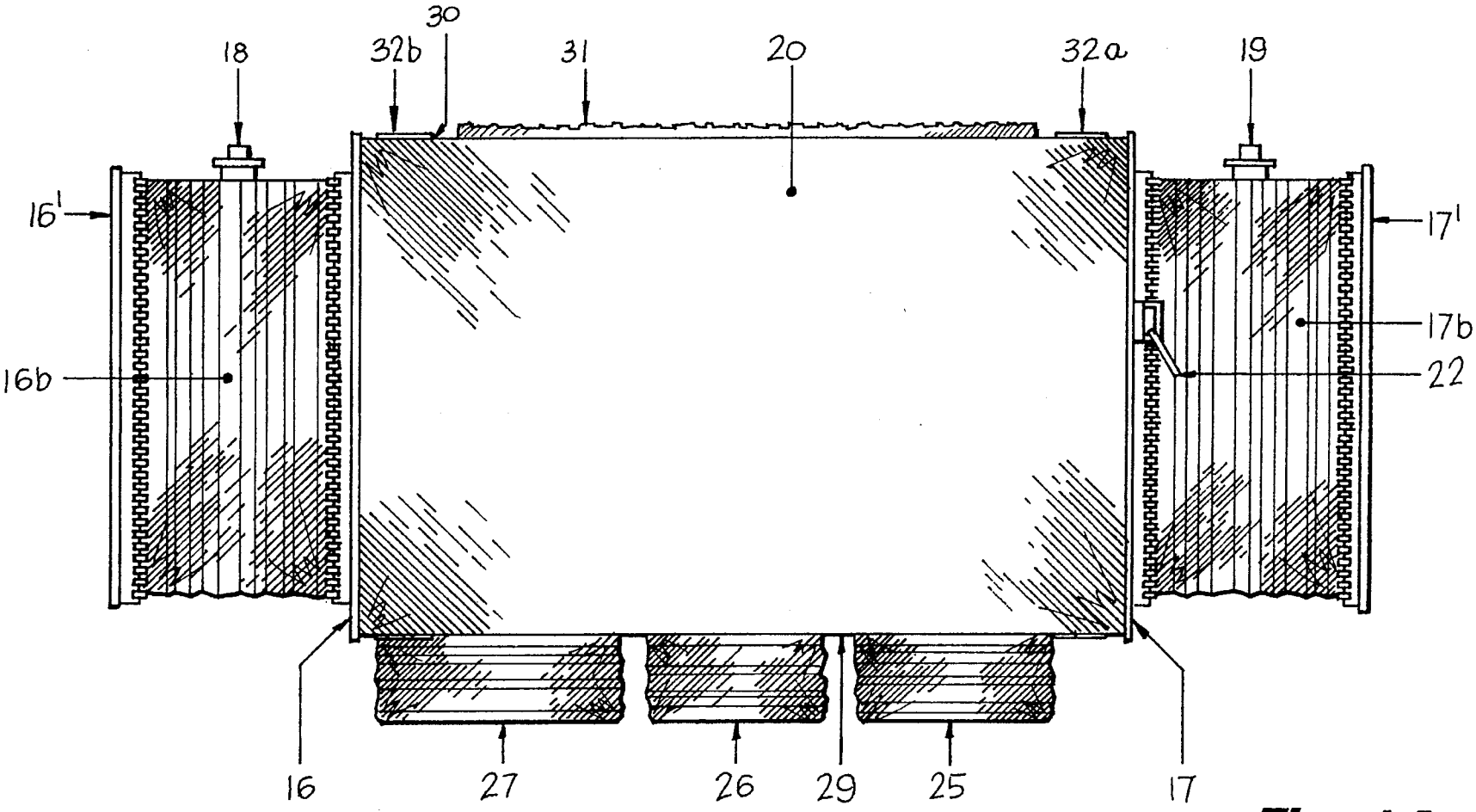
FIG. 14 is a bottom plan view of the beach carrying bag as in FIG. 8, shown in an open position.

As shown in FIG. 8, portable multi-compartment beach carry case 10 includes at least one compartment 12, 13 therein, each compartment 12, 13 being accessible through an opening.

Beach carry case 10 has a plurality of walls 11, 20, 16, 17, 29, 30 including generally horizontal top wall 11, generally horizontal bottom wall 20 in spaced relation away from top wall 11, and a plurality of generally vertical walls 16, 17, 29, 30 connecting top wall 11 and bottom wall 20.

Thermally insulated first storage compartment 12 accessible through a first closable opening in generally horizontal top wall of beach carry case 10. Non-insulated second storage compartment 13 is accessible through a further closable opening in generally horizontal top wall 11 of beach carry case 10.

First closable opening is adjacent said further closable opening in generally horizontal top wall 11 of beach carry case 10.

Therefore, thermally insulated first storage compartment 12 is adjacent to non-insulated second storage compartment 13.

Thermally insulated first storage compartment 12 has a removable, thermally insulated cover 14 closing first closable opening.

Second non-thermally insulated storage compartment 13 has a removable cover 15 closing second closable opening.

Beach carry case 10 includes a plurality of collapsible pockets 16*a*, 17*a*, each collapsible pocket 16*a*, 17*a* is expandable to an open position adjacent respective vertical walls 16, 17 and each collapsible pockets 16*a*, 17*a* has a closable opening at one edge thereof, with respective fastener closure means 18, 19 extending therealong.

Collapsible pockets 16*a*, 17*a* include respective elastic expandable walls 16*b*, 16*c*, 17*b*, 17*c* and respective outer flat walls, 16', 17'.

Beach carry case 10 includes a plurality of rigid exterior storage compartments 25, 26, 27, extending adjacent exterior rear side wall 29. Each rigid exterior storage compartment 25, 26, 27 has a closable opening at one edge thereof.

Other modifications may be made to the present invention, without departing from the scope of the invention, as noted in the appended claims.

We claim:

1. A portable multi-compartment beach carry bag comprising:

a carry case including at least one thermally insulated compartment therein accessible through an opening and at least one non-insulated compartment accessible through a further opening;

said carry case having a plurality of walls including a generally horizontal top wall and a generally horizontal bottom wall in spaced relation away from said top wall, and a plurality of generally vertical walls connecting said top wall and said bottom wall;

said carry case having at least one collapsible pocket expandable to an open position adjacent at least one of said walls, said collapsible pocket having an opening at one edge thereof;

said carry case having at least one rigid compartment adjacent at least one of said walls, said rigid compartment having an opening at one edge thereof;

said carry case having a flexible handle extending from said top wall;

at least one generally flattened pocket connected to at least one of said walls, said pocket having a slot opening provided in one side of said pocket; and, a flat piece of fabric material insertable within said pocket.

2. A portable multi-compartment beach carry bag comprising:

a carry case including at least one thermally insulated compartment therein accessible through an opening and at least one non-insulated compartment accessible through a further opening;

said carry case having a plurality of walls including a generally horizontal top wall and a generally horizontal bottom wall in spaced relation away from said top wall, and a plurality of generally vertical walls connecting said top wall and said bottom wall;

said carry case having at least one collapsible pocket expandable to an open position adjacent at least one of said walls, said collapsible pocket having an opening at one edge thereof;

said carry case having at least one rigid compartment adjacent at least one of said walls, said rigid compartment having an opening at one edge thereof;

said carry case having a flexible handle extending from said top wall;

at least one generally flattened pocket connected to at least one of said walls, said pocket having a slot opening provided in one side of said pocket; and, a flat piece of fabric material insertable within said pocket, said flat piece of fabric material including an inflatable portion thereof.

3. A portable multi-compartment beach carry bag comprising:

a carry case having a plurality of walls including a generally horizontal top wall and a generally horizontal bottom wall in spaced relation away from said top wall, and a plurality of generally vertical walls connecting said top wall and said bottom wall;

a carry case including at least one thermally insulated first storage compartment therein accessible through a first closable opening in said generally horizontal top wall of said carry case and at least one non-insulated second storage compartment accessible through a further closable opening in said generally horizontal top wall of said carry case;

said first closable opening being adjacent said further closable opening in said generally horizontal top wall of said carry case;

said thermally insulated first storage compartment adjacent to said non-insulated second storage compartment;

said thermally insulated first storage compartment having a removable, thermally insulated cover closing said first closable opening;

said second non-thermally insulated storage compartment having a removable cover closing said second closable opening;

said carry case having a plurality of collapsible pockets; each said collapsible pocket expandable to an open position adjacent at least one of said walls, each said collapsible pocket having a closable opening at one edge thereof, said closable opening having a fastener closure means extending therealong;

said closable openings of said collapsible pockets further having an elastic cover strip thereon;

said carry case having a plurality of rigid exterior storage compartments; each said rigid exterior storage compartment extending adjacent at least one exterior side of said walls, each said rigid exterior storage compartment having a closable opening at one edge thereof, said closable opening having a fastener closure means extending therealong;

said closable openings of each said rigid exterior storage compartments each having a flap cover;

said carry case having a flexible handle comprising a pair of handle extension pieces, said pair of handle pieces joinable by a joining means; said joinable handle pieces forming a single handle extending in spaced relation away from and above said generally horizontal top wall of said carry case;

at least one generally flattened storage pocket connected to said bottom wall of said carry case, said storage pocket having a slot opening provided in one side of said storage pocket, said slot opening closable by an elastic cover strip extending along said slot opening of said storage pocket; and, a flat piece of fabric material insertable within said storage pocket, said flat piece of fabric material including an inflatable portion thereof.

* * * * *